US006448933B1

(12) United States Patent
Hill et al.

(10) Patent No.: US 6,448,933 B1
(45) Date of Patent: Sep. 10, 2002

(54) POLARIZATION AND SPATIAL DIVERSITY ANTENNA ASSEMBLY FOR WIRELESS COMMUNICATION DEVICES

(75) Inventors: Robert Hill, Salinas; Thomas Trumbull, Redwood Estates, both of CA (US)

(73) Assignee: Tyco Electronics Logisitics AG (CH)

( * ) Notice: Subject to any disclaimer, the term of this patent is extended or adjusted under 35 U.S.C. 154(b) by 0 days.

(21) Appl. No.: 09/832,691

(22) Filed: Apr. 11, 2001

(51) Int. Cl.[7] ..... H01Q 1/24
(52) U.S. Cl. ..... 343/702; 343/829; 343/846
(58) Field of Search ..... 343/700 MS, 702, 343/846, 848, 829, 830, 729

(56) References Cited

U.S. PATENT DOCUMENTS 5,291,210 A * 3/1994 Nakase ..... 343/700 MS
5,767,810 A * 6/1998 Hagiwara et al. .... 343/700 MS
5,786,793 A * 7/1998 Maeda et al. ..... 343/700 MS
6,040,806 A * 3/2000 Kushihi et al. ..... 343/853
6,049,314 A * 4/2000 Munson et al. ..... 343/846
6,121,930 A * 9/2000 Grangeat et al. .... 343/700 MS

* cited by examiner

*Primary Examiner*—Don Wong
*Assistant Examiner*—Hoang Nguyen
(74) *Attorney, Agent, or Firm*—Fulbright & Jaworski L.L.P.

(57) ABSTRACT

The present invention discloses a novel PIFA-edge antenna and diversity antenna system operable over a wide range of conditions and exhibiting superior performance as part of a wireless LAN environment. The antenna of the present invention provides reliable and consistent omnidirectional performance while reducing the deleterious effects of multipath propagation interference which is often present in office environments having a variety of surfaces that passively reflect a broad range of frequencies useful within the broad spectrum the electromagnetic radiation (e.g., radio frequency or "RF") for transmitting analog or digital voice, data, images, and the like (herein "data") typically transmitted across the typical LAN.

37 Claims, 17 Drawing Sheets

FIG. 5A TABLE TOP POSITION (closed)
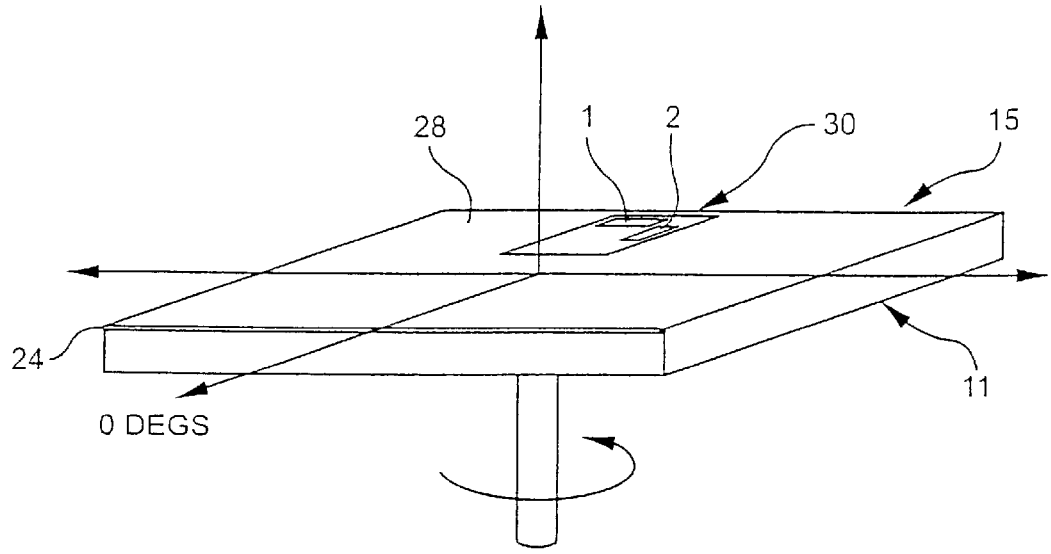
FIG. 5B TABLE TOP POSITION (opened)
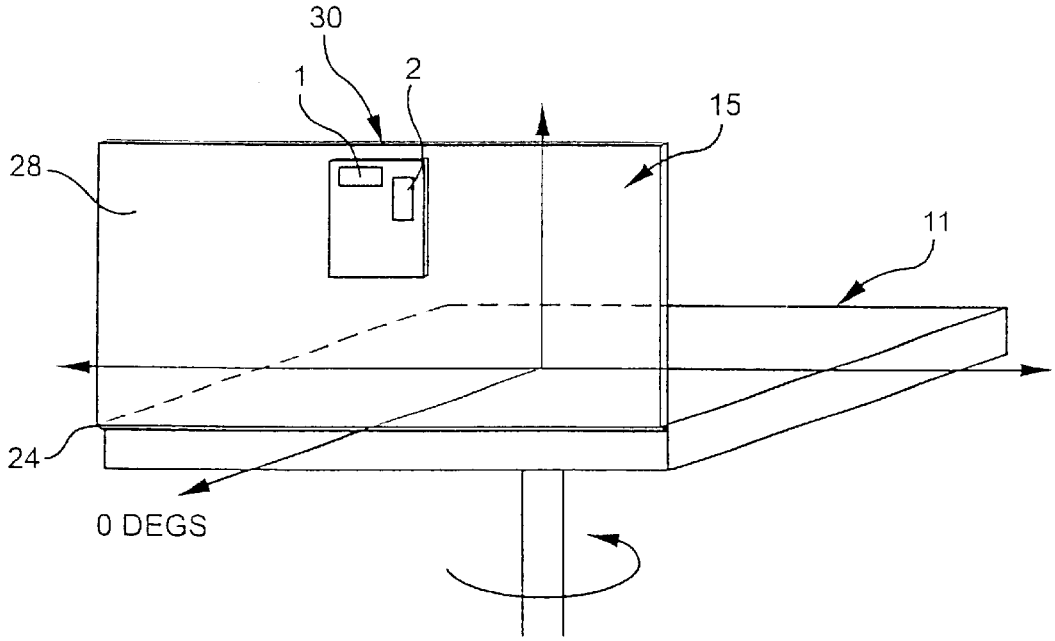

| Freq (MHz) | Trace | Beam Peak Deg | Beam Peak dB |
|---|---|---|---|
| 2400.00 | ——— | -145.13 | -4.66 |
| 2420.00 | ——— | -145.13 | -4.41 |
| 2440.00 | ——— | -141.21 | -3.69 |
| 2460.00 | ——— | -141.21 | -4.08 |

| Freq (MHz) | Trace | Beam Peak Deg | Beam Peak dB |
|---|---|---|---|
| 2480.00 | ——— | -141.21 | -4.9 |

POLARIZATION AND SPATIAL DIVERSITY ANTENNA ASSEMBLY FOR WIRELESS COMMUNICATION DEVICES

FIELD OF THE INVENTION

The present invention pertains generally to the field of antennas and antenna systems for wireless communication devices (WCD). In particular, the present invention relates to a PIFA-edge antenna and an omnidirectional diversity antenna system which exhibit improved wireless data transmission and reception for portable wireless communications devices, such as "laptop" computers, coupled to a computer network such as a wireless local area network (LAN).

BACKGROUND OF THE INVENTION

Prior art wireless communication devices have constantly strived toward improved performance while following the continuing trend toward lower cost, and ever more compact antenna designs. In wireless LAN data transfer operations, loss of signal strength, interruptions in a data transfer, and the well known deleterious effects of signal interference, including phase cancellation and polarization rotation due to multiple surfaces reflecting RF signals, all present potential sources of error during data transfer which must be reduced if not eliminated altogether so that the wireless LAN exhibits a level of stability and error-free operation approaching that of known hard-wired LAN computing and communication environments.

One related approach to the significant problem of multiple surfaces reflecting RF signals in an office environment (known as multipath propagation interference) is disclosed in U.S. Pat. No. 5,677,698 entitled, "Slot Antenna Arrangement for Portable Personal Computers," which issued on Oct. 14, 1997 to Snowdon. This related approach discloses two orthogonal slot antennas on the rear surface of a laptop computer that provides a modicum of polarization diversity for vertical and horizontal polarized RF signals only when the cover, or lid, of a laptop computer is oriented in the raised position. Thus, any advantages provided by this related antenna system only apply during the brief amount of time over the operating life of laptop computers outfitted with the antenna system disclosed that the cover is open. Thus, there exists in the related art a known obstacle to reliable operation of a wireless LAN system; namely, multipath interference propagation effects.

Local area networks (LAN) are used in the wireless transmission and reception of digitally-formatted data between sites within a building, between buildings, or between outdoor sites, using transceivers operating at frequencies in the range 2.4–2.5 GHz., 5.2–5.8 GHz., and others. Antennas operating over these frequency bands are required for the transceivers in LAN devices. A LAN structure permits many computerized devices to communicate with each other and/or with other computerized devices associated with the LAN. These other computerized devices may comprise such things as computer servers linked by optical or traditional electrically conducting conduit(s) to remote locations via a global computer system (e.g., the so-called internet or world wide web) as well as portable computers and personal digital assistants locally coupled to the LAN. In addition, peripheral computer equipment are often electronically coupled to the LAN either directly with conduit or using wireless network technology (e.g., RF transceivers). These peripheral devices typically include printing equipment, scanning equipment, photocopy equipment, facsimile transmission equipment, and the like.

Individual stations, or nodes, of a LAN may be randomly positioned relative the other stations in the LAN without regard to sources of multipath propagation interference. Thus, as exhibited in the prior art, a need exists to provide continuous, reliable access to all the devices coupled to a wireless LAN including the need for simple, low cost, and effective antenna systems to combat the ever present effects of multipath propagation interference. Accordingly, continuous improvement in the operation and packaging of omnidirectional antenna assemblies enhance operational performance of a wireless LAN and are desirable for transceiver units disposed in computerized devices coupled to a wireless LAN. Unfortunately, a significant drawback of omnidirectional antenna designs is the susceptibility to multipath propagation interference which reduces RF signal strength by phase cancellation, often resulting in unacceptable errors during data transfer operation when digital information is being transferred over a wireless LAN.

In many wireless systems it is desirable to employ some form of antenna diversity to combat multipath effects in the communication system. The antenna diversity can be accomplished via several approaches, as known and used in the prior art; namely, frequency diversity, time diversity, spatial diversity, and polarization diversity.

Frequency diversity refers to a technique whereby an antenna system rapidly alternates among several different frequencies within a desired operating band of frequencies to reduce multipath propagation interference by simply spreading data being transferred in a wireless LAN over discrete portions of a usable frequency bandwidth which naturally avoids interference between diverse frequencies.

Time diversity refers to a technique whereby radio-frequency (RF) data transmission and receipt are timed to occur when only a single signal is being transmitted or/or received at a time over a wireless LAN, thereby simply avoiding the potential for plural RF data signals from interfering with each other by carefully controlling each transmission and reception operation.

Spatial diversity refers to a technique whereby two or more antennas are strategically placed at physically different locations to reduce multipath propagation interference during data transfer transmission and receipt.

Polarization diversity refers to a technique whereby data transmission and data receipt are provided at a common frequency but having distinct signal polarization such as vertical polarization, horizontal polarization, or polarization upon a pre-selected azimuth (expressed with values having a magnitude between 0 degrees and +/−90 degrees).

Many prior art systems use a pair of patch antennas to form a spatially diverse antenna configuration. Such an antenna may be formed on a resin-based, ceramic, or other suitable dielectric substrate. A typical patch antenna includes the substrate, an electrically conducting patch member formed on one surface of the substrate, and a ground plane disposed on the opposing surface of the substrate. A via aperture, or other electrically conducting feed pathway, electrically couples the electrically conducting patch to an RF receiver/transmitter (i.e., transceiver). The use of high dielectric constant materials for the substrate results in an antenna which is physically small, especially when a ceramic substrate is utilized although such ceramic-based substrate patch antennas tend to be relatively expensive. Furthermore, connecting the antenna to a low cost circuit board often requires special connectors and cabling, which add cost to the system.

SUMMARY OF THE INVENTION

The present invention teaches, discloses and enables those of skill in the art of wireless communication device (WCD)

design and implementation to practice a PIFA-edge antenna and a novel diversity antenna system operable over a wide range of conditions and exhibiting superior performance as part of a wireless LAN environment. The antenna system of the present invention provides reliable and consistent omnidirectional performance while reducing the deleterious effects of multipath propagation interference which is often present in office environments having a variety of surfaces that passively reflect a broad range of frequencies useful within the broad spectrum the electromagnetic radiation (e.g., radio frequency or "RF") for transmitting analog or digital voice, data, images, and the like (herein "data") typically transmitted across the typical LAN.

In particular, the present invention teaches a polarization and spatial diversity antenna system suitable for use with a laptop computer, hand-held device such as a so-called personal digital assistant (PDA), or other new, emerging, diverse and/or reasonably foreseeable wireless device networks. Examples of such wireless devices include those designed to operate in a single wireless data environment or in combination with one or more discrete wireless data environment. Such wireless environments can be locally based, such as a LAN in a business, residential, or vehicular setting, including land, sea, and air vehicles. Another variety of wireless data environments benefiting from the teaching of the present invention include those with greater reach or having a wider coverage area, such as a wide area network (WAN), satellite and low power space-based wireless data environments.

The present invention also teaches, discloses and enables those of skill in the art of wireless communication device (WCD) design and implementation to practice a novel PIFA-edge antenna operable over a wide range of conditions and exhibiting superior performance. The PIFA-edge antenna according to the present invention is a low-profile antenna exhibiting generally equivalent performance as compared to other, generally larger, PIFA antennas. In a PIFA-edge antenna according to the present invention, the distance between the planar element and the ground plane is substantially smaller than other antennas having similar performance characteristics. The provision of an additional grounding leg facilitates a more compact, low profile antenna.

The antenna system of the present invention finds optimal use in many wireless transceiver devices, including wireless communications devices (WCD's) and other portable devices having a transceiver for wireless communication. One particular class of devices of finding applicability of the present invention includes portable laptop computers having a transceiver component for wireless communication. In one embodiment, the antenna structure according to the present invention is especially adapted for portable laptop computers and other portable wireless communication devices having an upper member, such as a cover, lid, clamshell, flip top, etc. and a lower member mechanically coupled to the upper member. The upper and lower member may be positioned in an "opened" state where the upper and lower members are oriented perpendicular to each other, or in a "closed" state where the upper and lower members are generally parallel to each other. It is another aspect of the present invention to provide an antenna assembly in the upper member or the lower member or in each of said upper and lower member, if desired.

Preferably such a cover member contains additional components and/or circuitry related to the operation of the WCD such as a passive display or a interactive display or other controllable buttons, switches, or other features for operating and using the WCD, but practice of the present invention does not require any such additional components.

Furthermore, such cover members may be manually operated or may be operated from a remote location and may be automatically opened and/or closed upon the occurrence of one or more events, such a time-out by an internal or external timing signal or upon receipt of a signal or upon completion of one of more computational or control operations originated within, or received by, the WCD from another location over a wireless communication network.

The antenna system of the present invention is preferably disposed on a rear surface of an upper cover member of a WCD and thus provides maximum response to two orthogonal polarizations of a nominal RF data signal (e.g., horizontal or vertical) for two extreme positions of the upper member with respect to the lower member (e.g., open/closed). More preferably, two antenna members comprise a set of metal plate antennas disposed as depicted in FIG. 1, FIG. 4, FIG. 5A, and FIG. 5B to provide adequate electrical isolation between the two antenna members.

One object of the present invention is to overcome limitations of the prior art antenna systems for each WCD coupled to a wireless local area network.

Another object of the present invention is to provide an improved polarization diversity antenna system for a laptop computer coupled to a wireless LAN using an antenna assembly as taught, enabled, and depicted herein.

Another object of the present invention is to provide at least one of the two available antenna patterns that is maximally responsive to vertical polarization with the upper cover member of a laptop computer in both the open state and the closed state. Meeting this particular object of the present invention finds particular utility in the art due to the fact that vertical polarization omnidirectional antennas are frequently used in a wireless LAN environment.

The individual antennas used in one embodiment of the present invention are metal plate type antennas, disposed on the upper member and preferably mounted near an outer corner of the upper member. Optimum spacing between the two antennas in the antenna system of the present invention has been determined in order to provide near-omnidirectional antenna performance patterns (e.g., see FIGS. 6–13).

Yet another object of the present invention is to provide a low profile PIFA-edge antenna having two grounding legs between the planar conductive element and the ground plane element. The second grounding leg provides the present antenna with generally equivalent bandwidth characteristics as compared to other PIFA antennas having a single grounding leg, though with a substantially smaller distance between the planar conductor and the ground plane. Additionally, for a given height constraint the additional grounding leg may increase the bandwidth characteristic of an antenna.

Yet another aspect of the present invention provides a low profile PIFA edge-type antenna having a relatively small spacing between the planar conductive element and the ground plane element. The spacing between the planar conductive element and the ground plane may be approximately $\frac{1}{4}\lambda$, significantly smaller than alternative PIFA antenna structures.

Other aspects and advantages of the invention as taught, enabled, and illustrated herein are readily ascertainable to those skilled in the art to which the present invention is directed, as well as insubstantial modifications or additions, all of the above of which falls clearly within the spirit and scope of the present invention as defined and specifically set forth in each individual claim appended hereto. The following drawings are intended to illustrate one or more embodiments of the present invention and are not intended to limit the scope and breadth of the invention hereof, which invention shall be as broad and shall reach all structures recited in the claims appended hereto and in reference to the whole of the disclosure hereof as understood by those of skill in the art of wireless technology generally, and the science and art of antenna and antenna system design, operation, and manufacture.

DESCRIPTION OF THE DRAWINGS

The accompanying drawings, which are incorporated in and form a part of this written description of the present invention, illustrate several embodiments of the invention.

FIG. 5A depicts a perspective view of a laptop computer in the closed state (or "tabletop position") and wherein a coordinate system and axis and direction of rotation are also illustrated (which serve as reference for the reader in conjunction with FIG. 7 through FIG. 17 herein).

FIG. 5B depicts a perspective view of a laptop computer in the open state (or "user position") and wherein a coordinate system and axis and direction of rotation are also illustrated (which serve as reference for the reader in conjunction with FIG. 7 through FIG. 17 herein).

DESCRIPTION OF PREFERRED EMBODIMENTS OF THE INVENTION

The present invention teaches, discloses and enables those of skill in the art of wireless communication device (WCD) design and implementation to practice a novel diversity antenna system operable over a wide range of conditions and exhibiting superior performance as part of a wireless LAN environment. The present invention additionally teaches, discloses and enables those of skill in the art of wireless communication device (WCD) design and implementation to practice a novel PIFA-edge antenna operable over a wide range of conditions and exhibiting superior performance.

An antenna system of the present invention provides reliable and consistent omnidirectional performance while reducing the deleterious effects of polarization rotation from reflections and phase cancellation due to multipath propagation interference which occur in indoor office spaces as well as any network location having a variety of surfaces that passively reflect frequencies within the useful spectrum band of electromagnetic radiation (e.g., radio frequency or "RF") energy used for transmitting analog or digital voice, data, images, and the like (herein "data") typically transmitted across the typical LAN, whether hard-wired or wireless.

Figure 1:
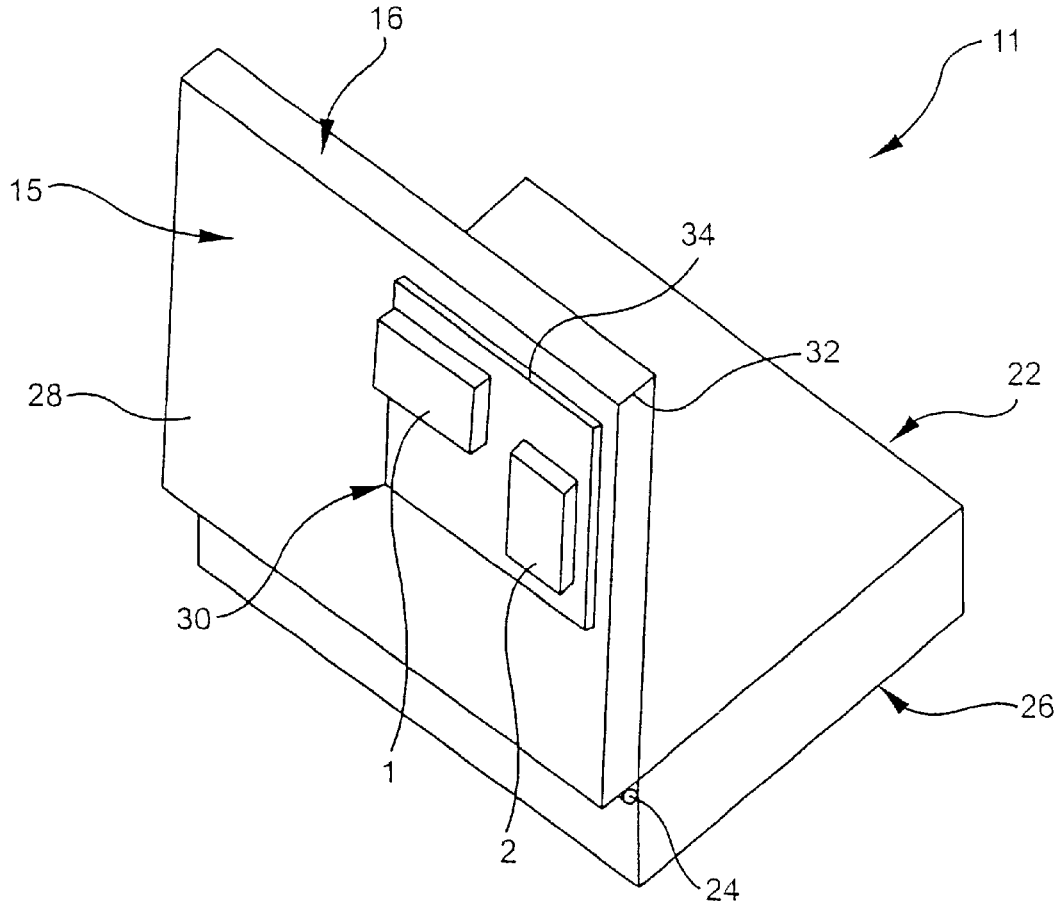
FIG. 1 depicts a perspective view of one embodiment of a wireless communication device utilizing an antenna assembly according to the present invention.

With reference to FIG. 1, on aspect of the present invention teaches a polarization and spatial diversity antenna system 30 suitable for use with a wireless communication device (WCD) 11, such as a laptop computer 22, hand-held device such as a so-called personal digital assistant (PDA), or other new, emerging, diverse and reasonably foreseeable wireless device networks. Examples of such wireless devices 11 include those designed to operate in a single wireless data environment or in combination with one or more discrete wireless data environment. Such wireless environments can be locally based, such as a LAN in a business, residential, or vehicular setting, including land, sea, and air vehicles. Another variety of wireless data environments benefiting from the teaching of the present invention include those with greater reach or having a wider coverage area, such as a wide area network (WAN), satellite and low power space-based wireless data environments.

One embodiment of the antenna system of the present invention is especially adapted for those wireless communication devices having an upper member 15, such as a cover, lid, clamshell, flip top, and a lower member 26 mechanically coupled to the upper member 15 by a hinge member 24. One such device is a laptop computer 22. During operation of the laptop computer 22, the upper member 15 and lower member 26 may be provided in the fully open state where they are oriented generally perpendicular to each other. The antenna assembly 30 of the present invention may be placed in the upper member 15 or the lower member 26 or in each of said upper and lower member, if desired.

Preferably such an upper, or cover, member 15 contains additional components and/or circuitry related to the operation of the WCD 11 such as a passive display or a interactive display or other controllable buttons, switches, or other features (not shown) for operating and using the WCD 11 but practice of the present invention does not require any such additional components.

The antenna system 30 of the present invention is preferably disposed on a rear, or top, surface 28 of an upper cover member 15 of a WCD 11 and thus provides maximum response to two orthogonal polarizations of a nominal RF data signal (e.g,. horizontal or vertical) for two extreme positions of the upper member 15 with respect to the lower member 26 (e.g,. open/closed). More preferably, two antenna members 1,2 comprise a set of metal plate antennas disposed as depicted in FIG. 1, FIG. 4, FIG. 5A, and FIG. 5B to provide adequate electrical isolation between the two antenna members 1, 2.

Practice of the present invention provides an improved polarization diversity antenna system 30 for a laptop computer 22 coupled to a wireless LAN using the antenna assembly as taught, enabled, and depicted herein. The present invention provides at least one of the two available antenna patterns that are maximally responsive to vertical polarization with the upper cover member 15 of a laptop computer 22 in both the open state and the closed state. Meeting this particular object of the present invention finds particular utility in the art due to the fact that vertical polarization omnidirectional antennas are frequently used in a wireless LAN environment. The individual antennas 1, 2 useful in one embodiment of the present invention are metal plate type antennas, disposed on the upper member 15 and preferably mounted near an outer corner 32 of a laptop computer 22 when the upper member 15 is in the open state. In one embodiment the upper member 15 (or cover member) is metallic and, further, each antenna 1, 2 may be spaced apart from the surface 28 of the cover member 15. For example, each antenna 1, 2 may be mounted onto a shield of an electronic assembly, such as a transceiver (not shown), which is further mechanically coupled to, or an integral part of, the cover member 15. Optimum spacing between the two antennas 1, 2 in the antenna system 30 of the present invention has been determined in order to provide near-omnidirectional antenna performance patterns (e.g., see FIGS. 6–13).

Reference may be made to FIG. 1 which is a perspective view of one embodiment of a WCD 11, a laptop computer 22 having a cover member 15 having a first antenna 1 and a second antenna 2 electrically coupled thereto as an operable antenna assembly 30. The actual location of the antenna assembly 30 on the upper surface 28 of the upper member 15 is not critical, however, a location near a top peripheral edge 16 of the upper member 15 is preferred. The antennas 1, 2 are oriented at 90 degrees to each other (i.e., orthogonal orientation) thereby providing vertical and horizontal polarization with the cover 15 in the open (or "user position") state and providing vertical polarization when the cover member 15 is in the closed (or "tabletop position") state. A substantially omnidirectional azimuth radiation patter is also achieved when the cover member 15 is in the closed state.

Figure 2B:
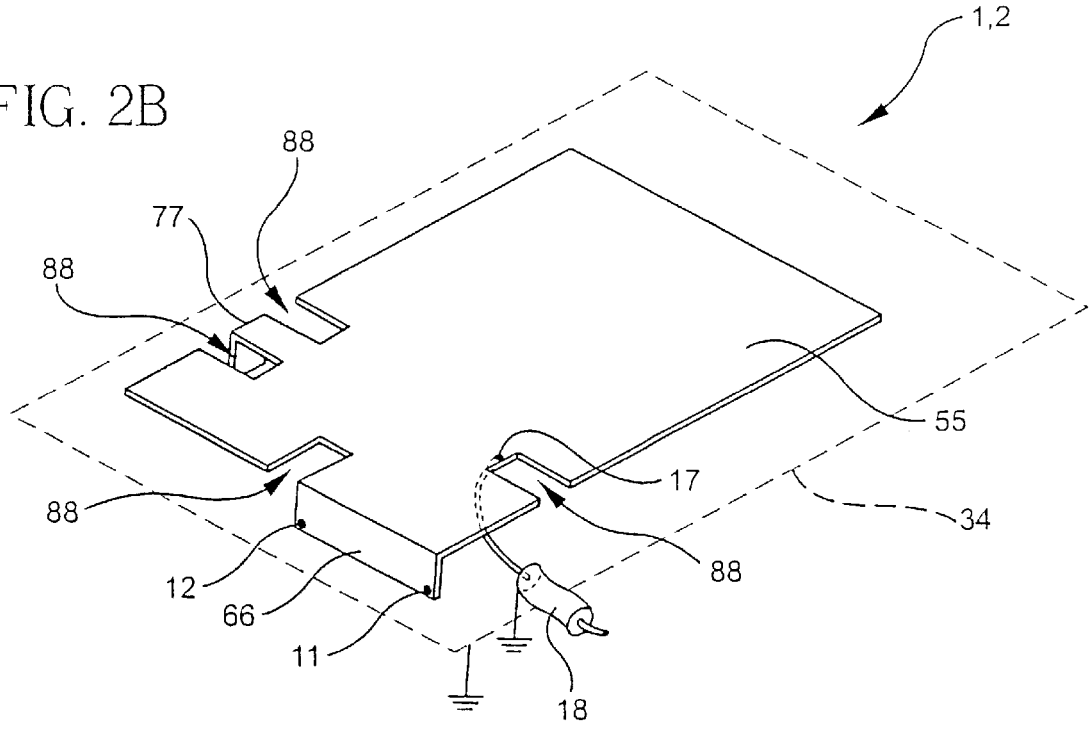
FIG. 2B depicts a perspective view of the PIFA-edge type antenna illustrated in FIG. 2A rotated approximately ninety degrees.
Figure 2A:
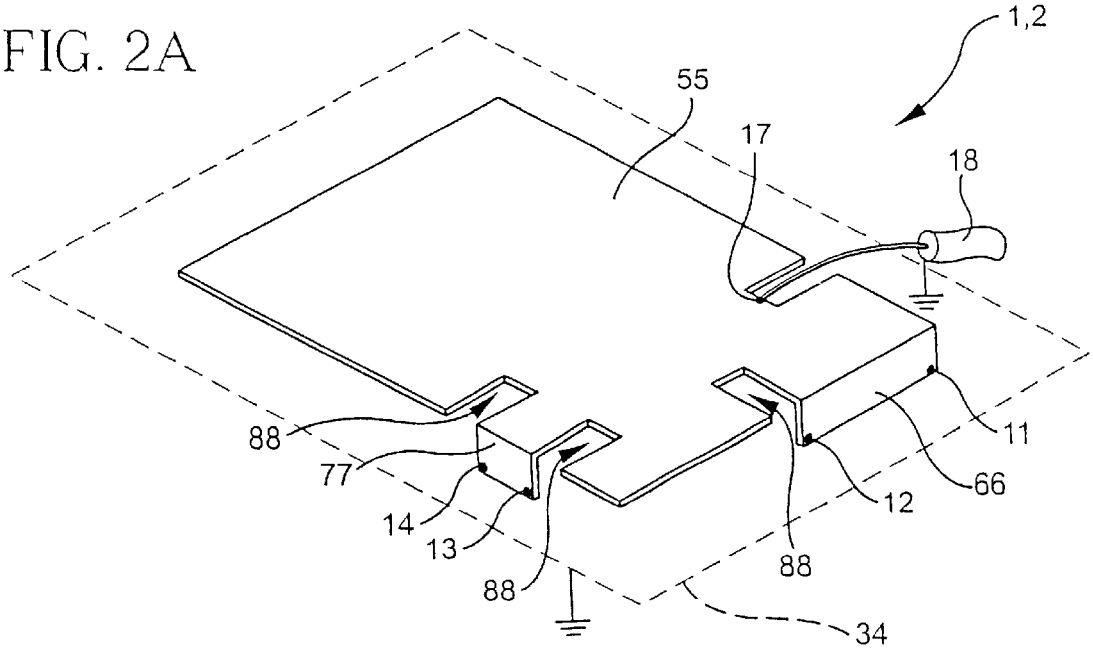
FIG. 2A depicts a perspective view of a metal plate, or PIFA-edge type, antenna usable in conjunction with the present invention.

FIG. 2A and FIG. 2B together depict in perspective views of a metal plate antenna 1, 2 usable in conjunction with the present invention. The antennas 1, 2, are formed into essentially three electrically conducting portions; namely major conductive element 55, leg member 66, and leg member 77 which typically comprise metal material but can be made of a wide variety of materials including a resin-based member selectively plated with electrically conducting material(s), or having such materials deposited thereon using known metal deposition techniques. Major conductive element 55 is generally planar in shape and in general parallel alignment with the ground plane 34 of the wireless device. Leg members 66 and 77 are also generally planar in shape, though in general perpendicular alignment with the ground plane 34 of the wireless device. As disclosed in FIGS. 3A and 3B, leg member 66 is substantially larger (wider) than leg member 77. Both leg members 66 and 77 are approximately equal in height and are each operatively coupled to the ground plane 34. As compared to other PIFA antennas having a single grounding leg, the dual grounding legs 66, 77 provide the present antenna with generally equivalent bandwidth, though with a substantially smaller distance between the planar conductor 55 and the ground plane 34. Additionally, for a given height constraint the additional grounding legs 66, 77 may increase the bandwidth characteristic of an antenna.

During manufacture of the antenna assembly, the suitably formed metallic antennas 1, 2 are coupled to a ground plane member 34 so that the major conductive elements 55 of the antennas 1, 2 are generally parallel to the ground plane member 34. The ground plane 34 may be defined by a conductive panel or portion of the cover member 15, or in alternative embodiments the ground plane 34 may be a separate conductive element which is coupled to the ground plane of the wireless device. The ground plane member 34 electrically couples to the antennas 1, 2 where leg member 66 meets the ground plane member 34 (i.e., between reference points 11, 12 shown in FIG. 2B). The ground plane member 34 also electrically couples to the antennas 1, 2 where leg member 77 meets the ground plane member 34 (i.e., between reference points 13, 14 shown in FIG. 2A). As a result, a single nominal 50 ohm feedpoint impedance is defined between reference point 17 and the ground plane member 34.

Referring again to FIGS. 2A and 2B, the major conductive element 55 further includes a plurality of notch structures or removed portions 88. One or more notch structures 88 are associated with the leg members 66, 77, and feed point 17. The notch structures 88 of the major conductive element 55 are optional, and may not be required to practice other embodiments of the present invention. The optional notch structures 88 are illustrated as generally rectangular removed portions of the major conductive element 55. Alternative notch structures 88 may include differently-shaped removed portions. The leg member 77 has a pair of notches 88, one disposed upon either side of the leg member 77. The size of the notches 88 associated with the leg member 77 may be adjusted to facilitate optimum tuning of the inductance between the conductive element 55 and the ground plane. The leg member 66 has a single notch 88 disposed upon one side of the leg member 66. The feed point 17 is defined within yet another notch 88 opposite the leg member 77. The size of the notch structure 88 associated with the feed point 17 may be adjusted to provide optimum matching, e.g., an unbalanced 50 ohm feed point impedance at the feed point 17.

Figure 2D:
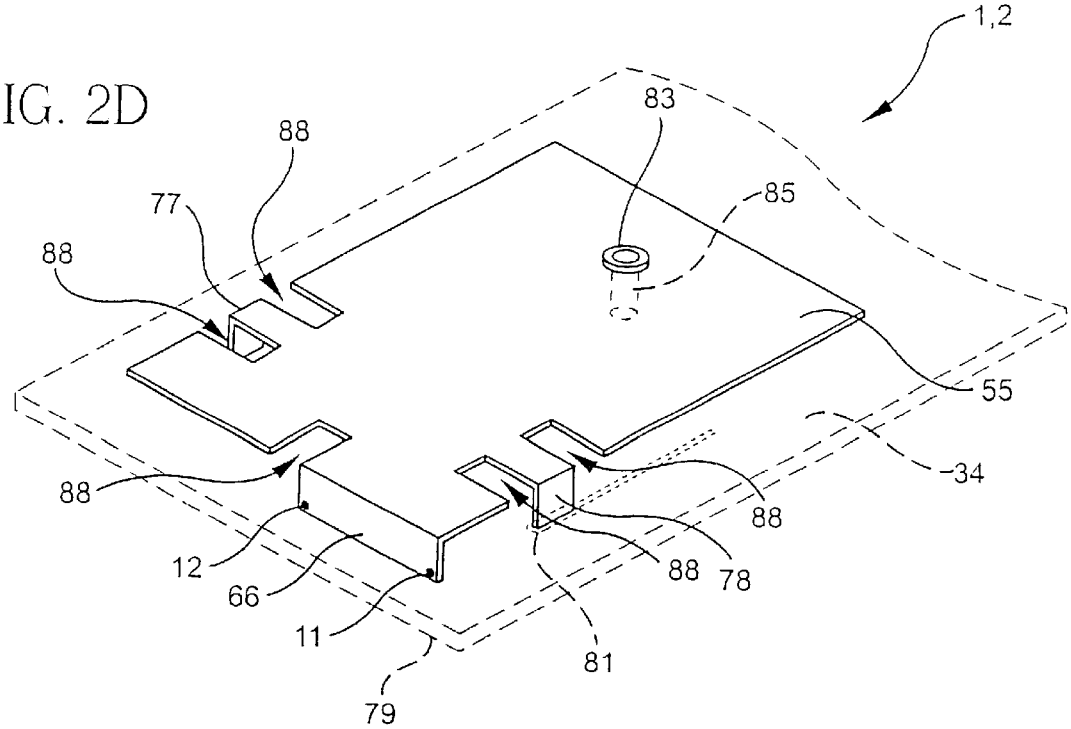
FIG. 2D depicts a perspective view of the PIFA-edge type antenna illustrated in FIG. 2C rotated approximately ninety degrees.
Figure 2C:
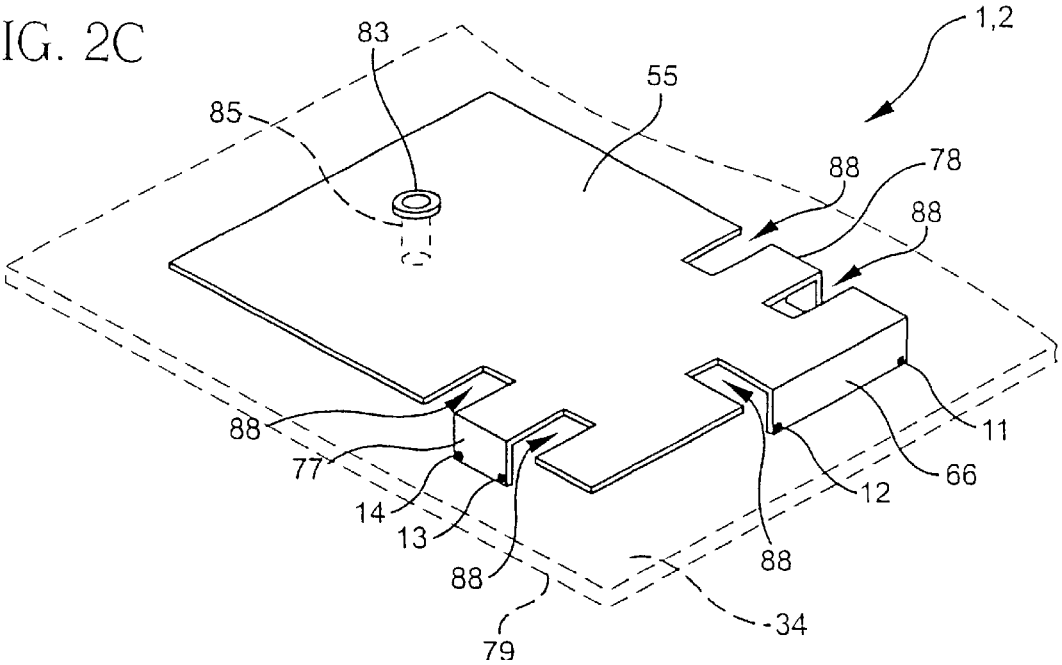
FIG. 2C depicts a perspective view of another embodiment of a metal plate, or PIFA-edge type, antenna usable in conjunction with the present invention.

FIG. 2C and FIG. 2D together depict perspective views of another embodiment of a PIFA-edge antenna 1, 2 usable in conjunction with the present invention. Equivalent elements of FIGS. 2A–2D are designated with the same numerals. The antennas 1, 2, are formed into essentially four electrically conducting portions; namely major conductive element 55, leg member 66, leg member 77, and leg member 78. In one preferred embodiment, the antennas 1,2 may be manufactured of a bent sheet metal, formed into the shape as indicated in the drawings. Alternatively, the antennas 1,2 may be made of a wide variety of materials including a resin-based member selectively patterned via deposition, etching and/or plating to form electrically conducting areas. Alternative manufacturing approaches may be appreciated by those skilled in the relevant arts. Major conductive element 55 is generally planar in shape and in general parallel alignment with the ground plane 34 of the wireless device. Leg members 66, 77, 78 are also generally planar in shape, though in general perpendicular alignment with the ground plane 34 of the wireless device. Leg member 78 defines the feed point for this antenna embodiment, and is provided at an edge of the conductive element 55 between a pair of notch structures 88. Leg members 66, 77, 78 are approximately equal in height. An optional aperture 83 may be disposed upon the major conductive element 55 proximate its free end. As described hereinafter, the optional aperture 83 may cooperate with a support structure 85 to maintain the major conductive elements 55 orientation relative to the ground plane 34.

During manufacture of the antenna assembly, the suitably formed metallic antennas 1, 2 are coupled to a dielectric board 79 having a ground plane member 34 and a signal port 81 so that the major conductive elements 55 of the antennas 1, 2 are generally parallel to the ground plane member 34. Leg member 78 is operatively coupled to the signal port 81 such as via soldering, or other known electrical connection techniques. The ground plane member 34 electrically couples to the antennas 1, 2 where leg member 66 meets the ground plane member 34 (i.e., between reference points 11, 12 shown in FIG. 2B). The ground plane member 34 also electrically couples to the antennas 1, 2 where leg member 77 meets the ground plane member 34 (i.e., between reference points 13, 14 shown in FIG. 2C). A support post 85 engages the major conductive element 55 proximate the optional aperture 83 to support and maintain the orientation of the conductive element 55 relative to the ground plane 34. Alternative support structures would also be appreciated, such alternative approaches may not require aperture 83.

Figure 3B:
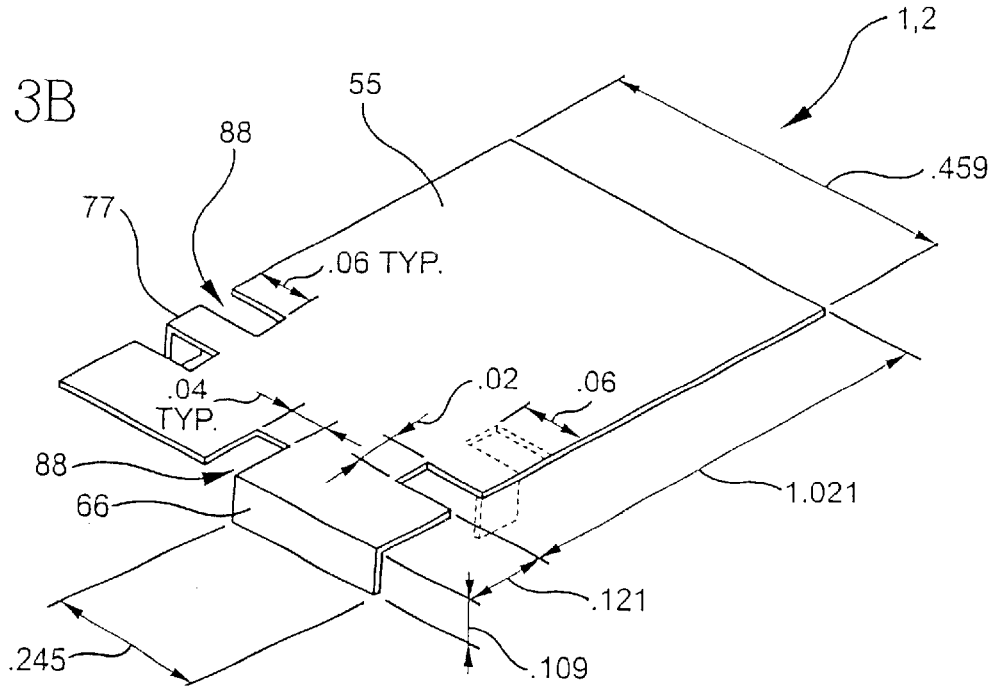
FIG. 3B depicts a perspective view of the PIFA-edge type antenna illustrated in FIG. 3A rotated approximately ninety degrees and wherein the dimensions of said PIFA-edge type antenna are depicted for ease of reference.
Figure 3A:
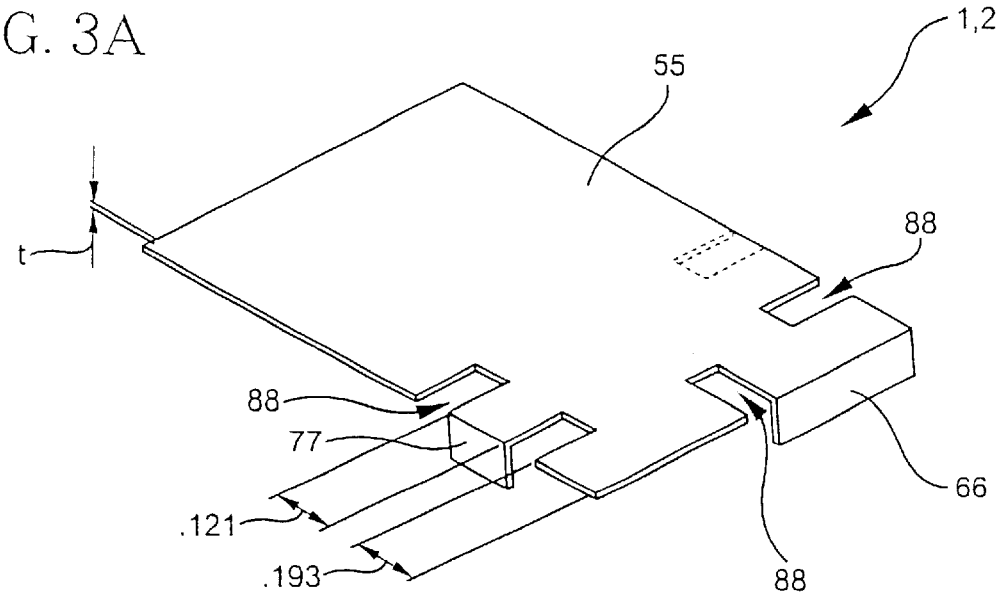
FIG. 3A depicts a perspective view of a metal plate, or PIFA-edge type, antenna usable in conjunction with the present invention and wherein the dimensions of said PIFA-edge type antenna are depicted for ease of reference.

FIG. 3A depicts a perspective view of a metal plate portion of an antenna according to the present invention and wherein the dimensions of said antenna portion are depicted for operation over the 2.4–2.48 GHz. frequency range. The height of the major conductive element 55 is indicated as 0.109 inch, or approximately $1/40^{th}\lambda$($\lambda$: 2.50 GHz).

FIG. 3B which depicts a perspective view of the metal place portion of the antenna illustrated in FIG. 3A rotated approximately ninety degrees and wherein the dimensions of said antenna are depicted for operation over the 2.4–2.48 GHz. frequency range.

Figure 4:
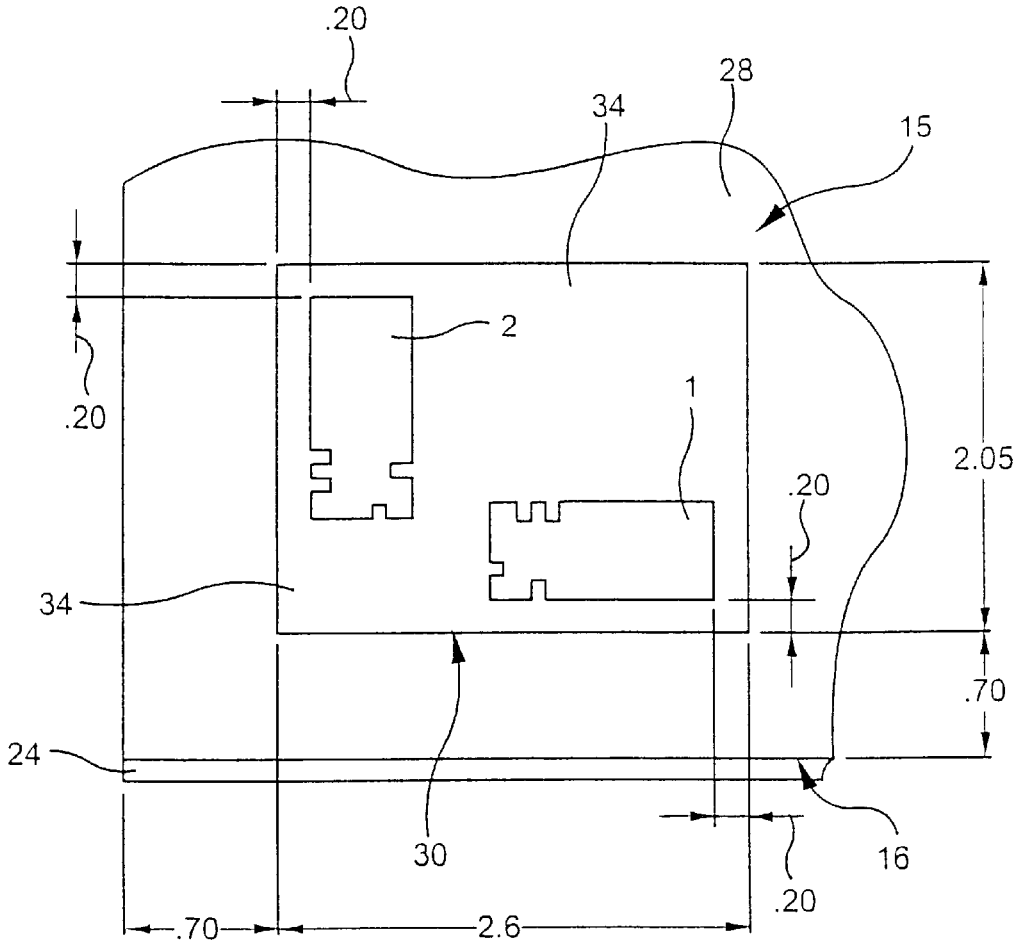
FIG. 4 is a plan view of a preferred orientation of the two antenna assembly of the present invention and wherein the spacing of each said PIFA-edge type antenna with respect to the periphery of a nominal laptop computer.

FIG. 4 shows a plan view of a preferred orientation of the antenna assembly of the present invention and the spacing of each antenna with respect to the periphery of a nominal laptop computer.

FIG. 5A depicts a perspective view of a laptop computer in the closed state (or "tabletop position") and wherein a coordinate system and axis and direction of rotation are also illustrated (which serve as reference for the reader in conjunction with FIG. 6 through FIG. 16 herein).

FIG. 5B depicts a perspective view of a laptop computer in the open state (or "user position") and wherein a coordinate system and axis and direction of rotation are also illustrated (which serve as reference for the reader in conjunction with FIG. 6 through FIG. 16 herein).

Figure 6:
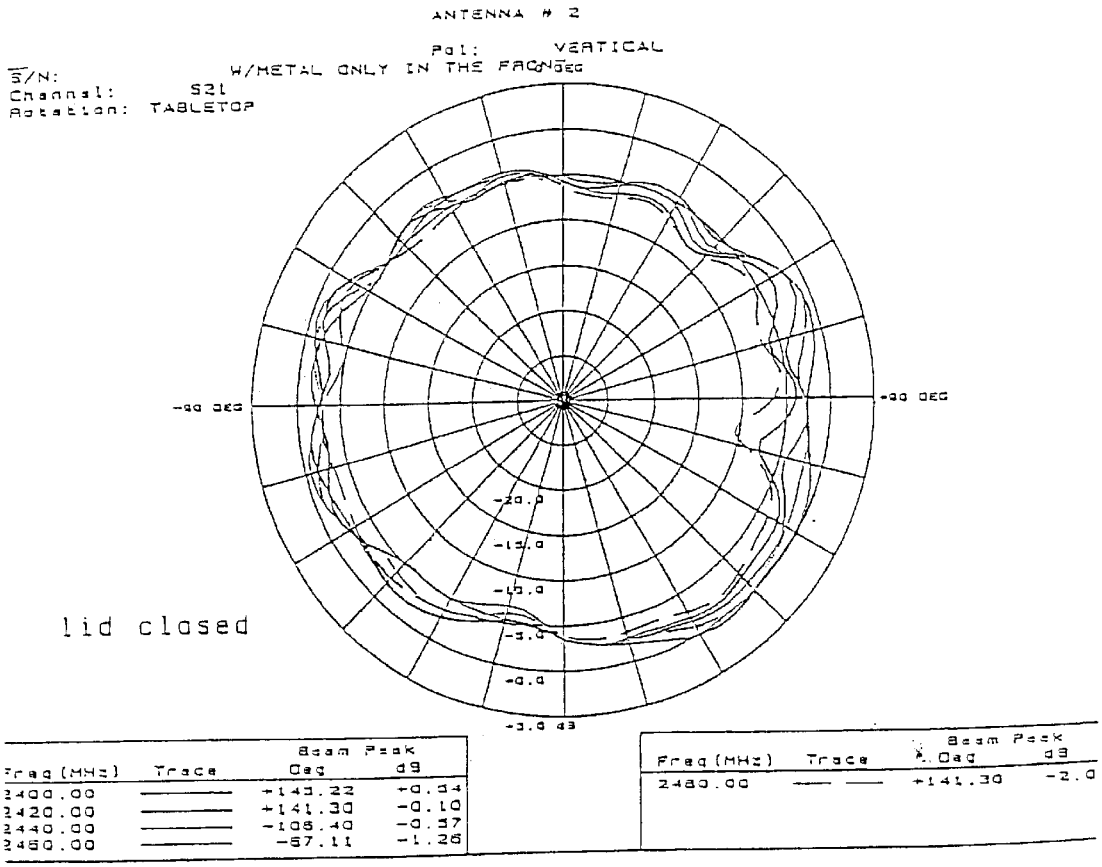
FIG. 6 is a graphical representation showing test data from an antenna designed in accordance with the present invention including the free-space azimuth pattern and a table setting forth the signal gain (in decibels) for a discrete five frequencies for the antenna #2 oriented in a table top (closed) state and wherein the source antenna is vertically polarized.
Figure 7:
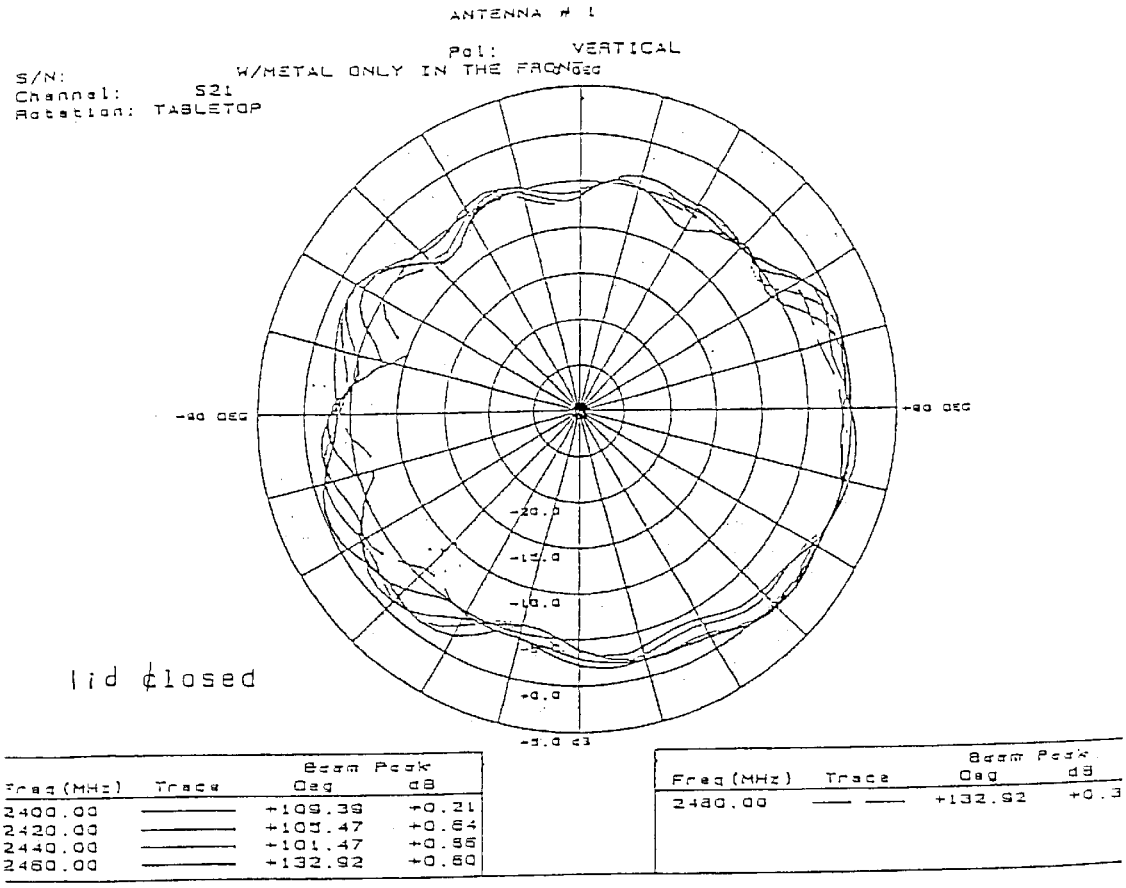
FIG. 7 is a graphical representation showing test data from an antenna designed in accordance with the present invention including the free-space azimuth pattern and a table setting forth the signal gain (in decibels) for a discrete five frequencies for the antenna #1 oriented in a table top (closed) state and wherein the source antenna is vertically polarized.

FIG. 6 and FIG. 7 are graphical representations showing test data from an antenna designed in accordance with the present invention including the free-space azimuth gain patterns for a discrete five frequencies. Antenna 1 (FIG. 7) and antenna 2 (FIG. 6) were oriented in a table top (closed) state and the source antenna was vertically polarized for both antenna 1 and antenna 2. Those of skill in the art will appreciate that either antenna 1, 2 can be used in the configuration with upper member 15 of the laptop computer 22 in the closed (or "tabletop position) state because both antennas 1, 2 exhibit omnidirectional radiation patterns. However, because of the spatial orientation of the antennas 1, 2 (i.e., perpendicular to each other) each antenna 1, 2 favors a specific spatial quadrant.

Figure 8:
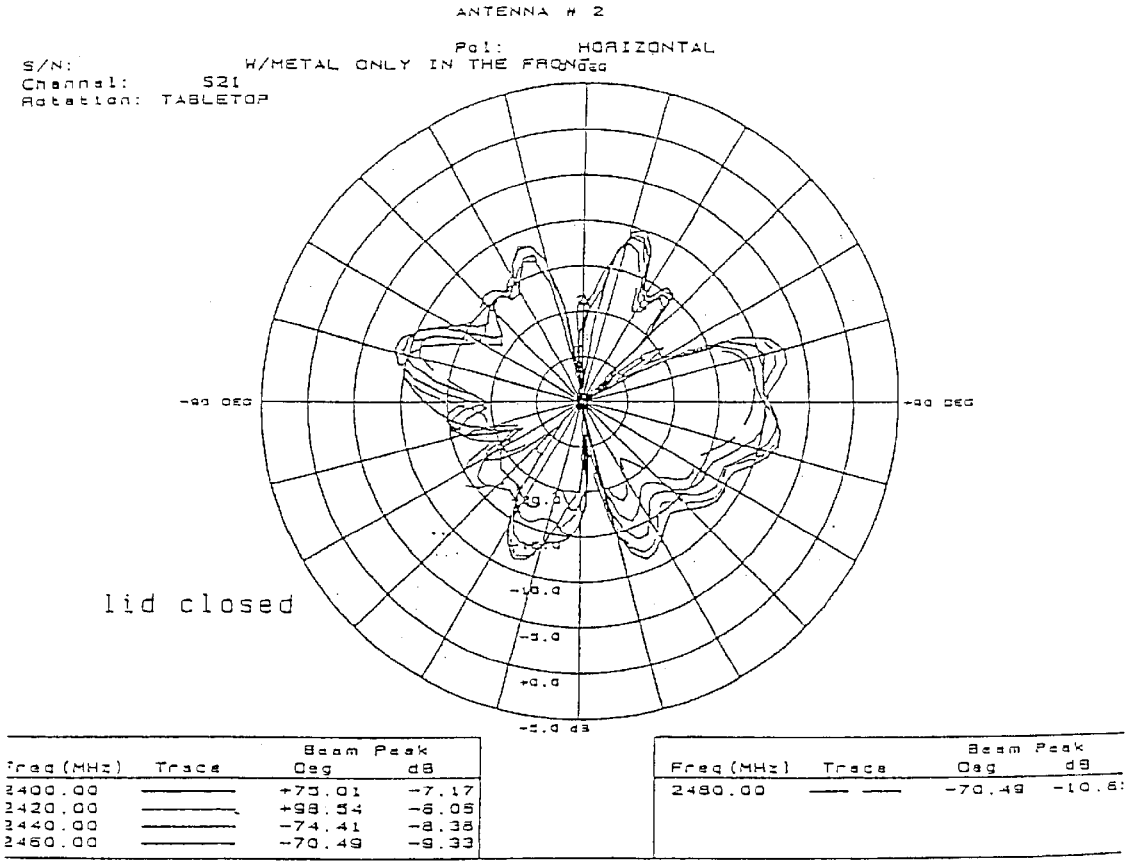
FIG. 8 is a graphical representation showing test data from an antenna designed in accordance with the present invention including the free-space azimuth pattern and a table setting forth the signal gain (in decibels) readings for a discrete five frequencies for the antenna #2 oriented in a table top (closed) state and wherein the source antenna is horizontally polarized.
Figure 9:
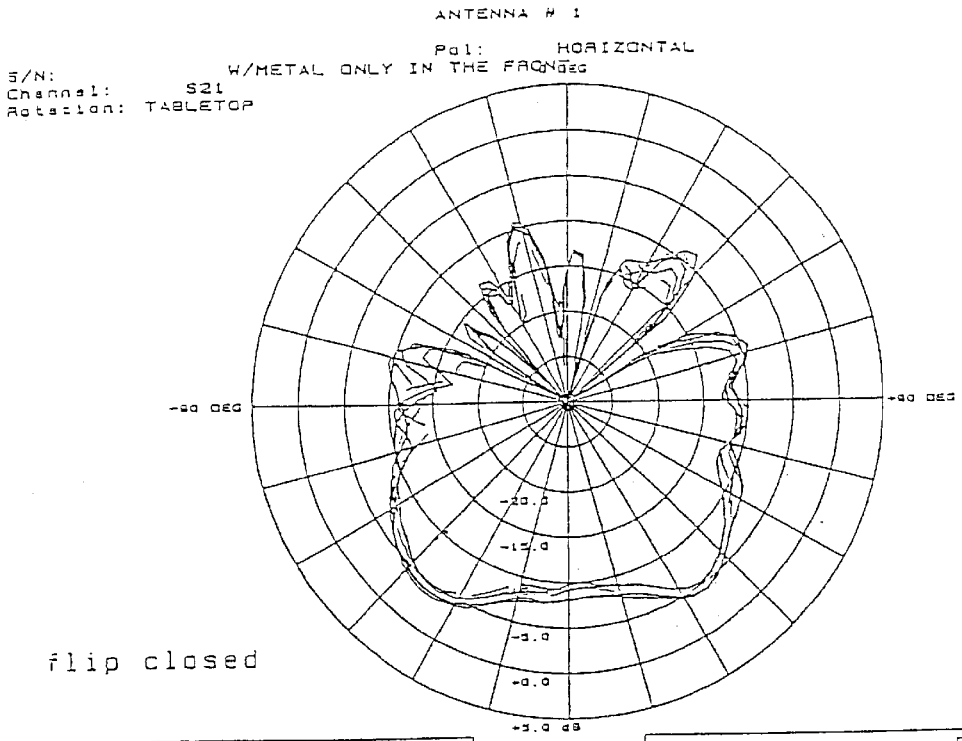
FIG. 9 is a graphical representation showing test data from an antenna designed in accordance with the present invention including the free-space azimuth pattern and a table setting forth the signal gain (in decibels) for a discrete five frequencies for the antenna #2 oriented in a table top (closed) state and wherein the source antenna is horizontally polarized.

FIG. 8 and FIG. 9 are graphical representations showing test data from an antenna designed in accordance with the present invention and including the free-space azimuth gain patterns for a discrete five frequencies. Antenna 1 (FIG. 9) and antenna 2 (FIG. 8) were oriented in a table top (closed) state and the source antenna is horizontally polarized. Those of skill in the art will readily appreciate that antenna #1 is favored under the conditions of the test (based on the results depicted in FIG. 8 and FIG. 9) when the upper member 15 is in the closed (or "tabletop position") state.

Figure 10:
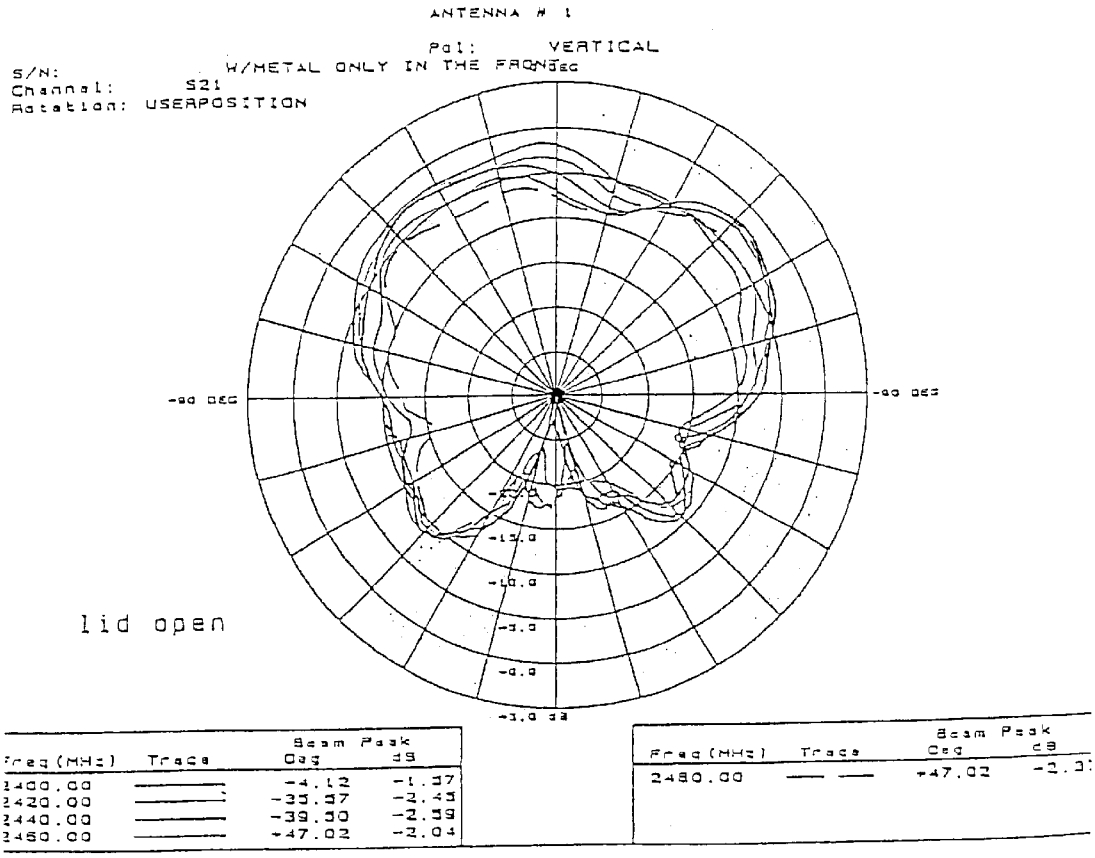
FIG. 10 is a graphical representation showing test data from an antenna designed in accordance with the present invention including the free-space azimuth pattern and a table setting forth the signal gain (in decibels) readings for a discrete five frequencies for the antenna #1 oriented in a user position (open) state and wherein the source antenna is vertically polarized.
Figure 11:
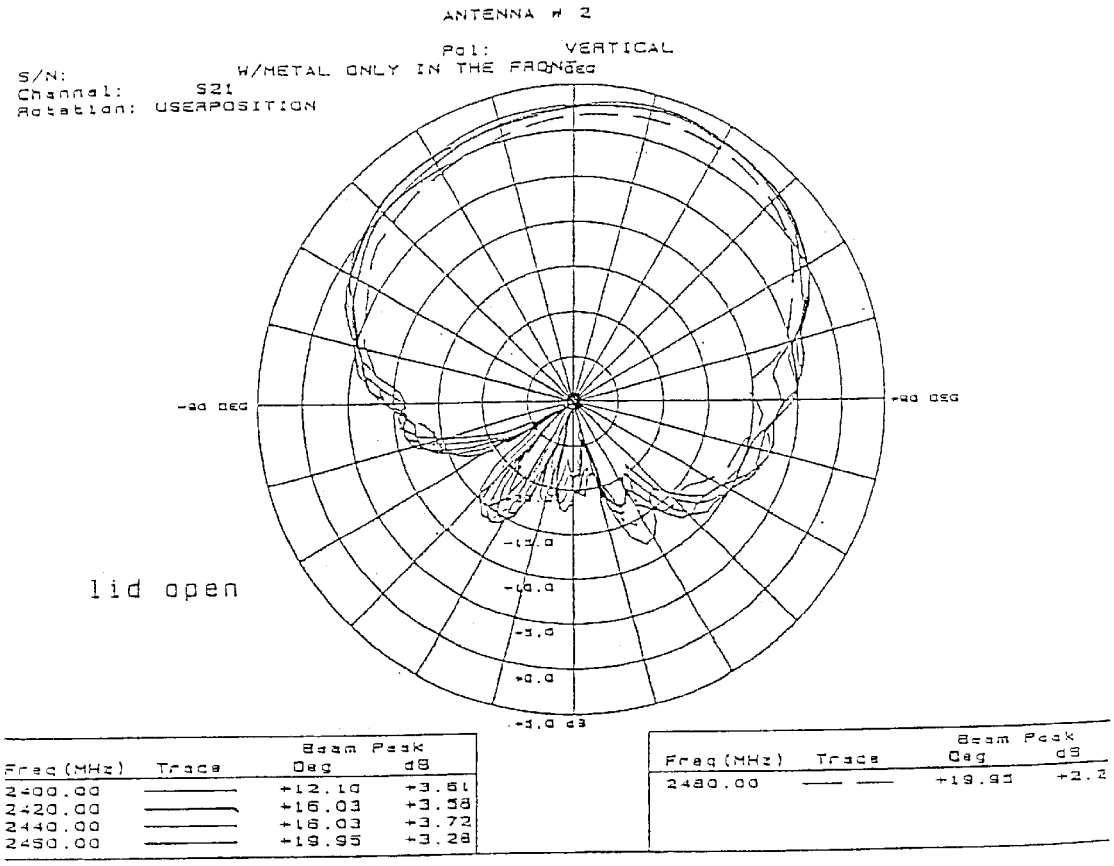
FIG. 11 is a graphical representation showing test data from an antenna designed in accordance with the present invention including the free-space azimuth pattern and a table setting forth the signal gain (in decibels) readings for a discrete five frequencies for the antenna #2 oriented in a user position (open) state and wherein the source antenna is vertically polarized.

FIG. 10 and FIG. 11 are graphical representations showing test data from an antenna designed in accordance with the present invention including the free-space azimuth pattern and setting forth the signal gain (in decibels) for a discrete five frequencies for the antenna #1 (FIG. 10) and antenna #2 (FIG. 11) oriented in a user position (open) state and wherein the source antenna was vertically polarized. Those of skill in the art will note that antenna #2 responds to vertically polarized signals in a more favorable manner as compared to antenna #1. Accordingly, in a diversity situation where the incoming radio waves are vertically polarized, antenna #2 would be the antenna selected for data transfer operations.

Figure 12:
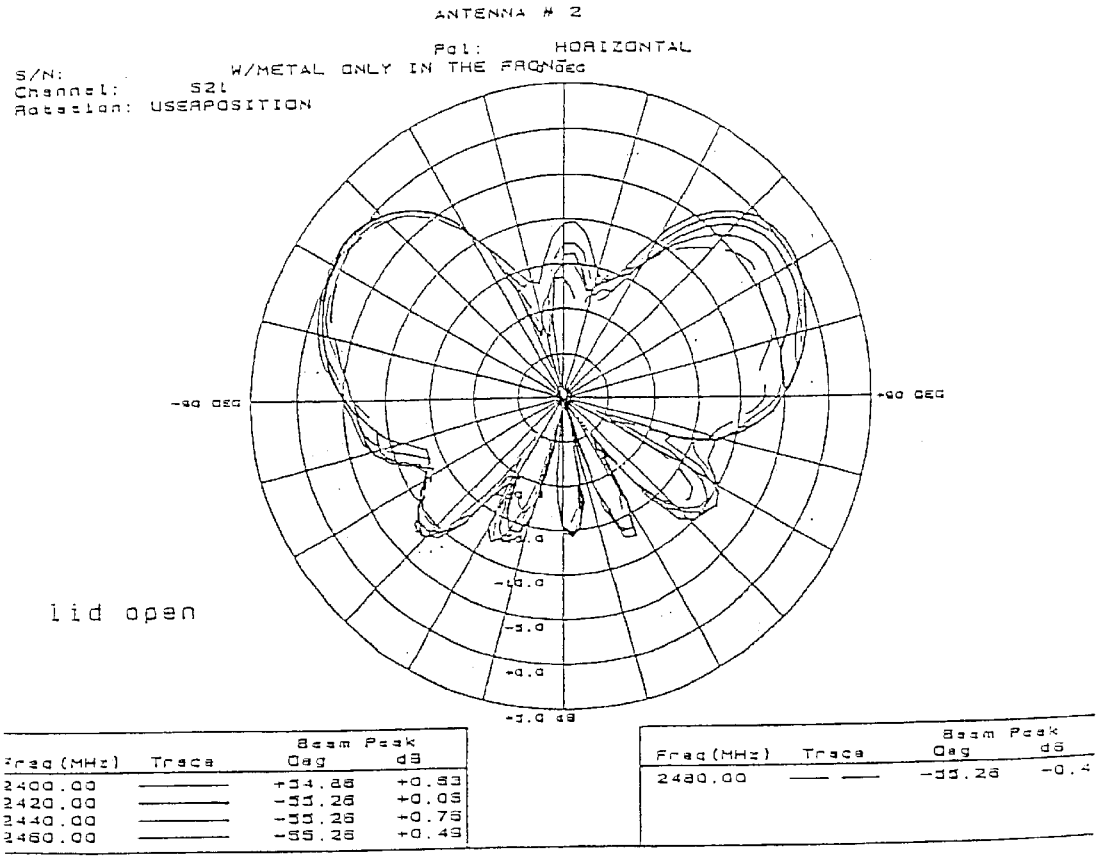
FIG. 12 is a graphical representation showing test data from an antenna designed in accordance with the present invention including the free-space azimuth pattern and a table setting forth the signal gain (in decibels) and peak azimuth readings for a discrete five frequencies for the antenna #2 oriented in a user position (open) state and wherein the source antenna is horizontally polarized.
Figure 13:
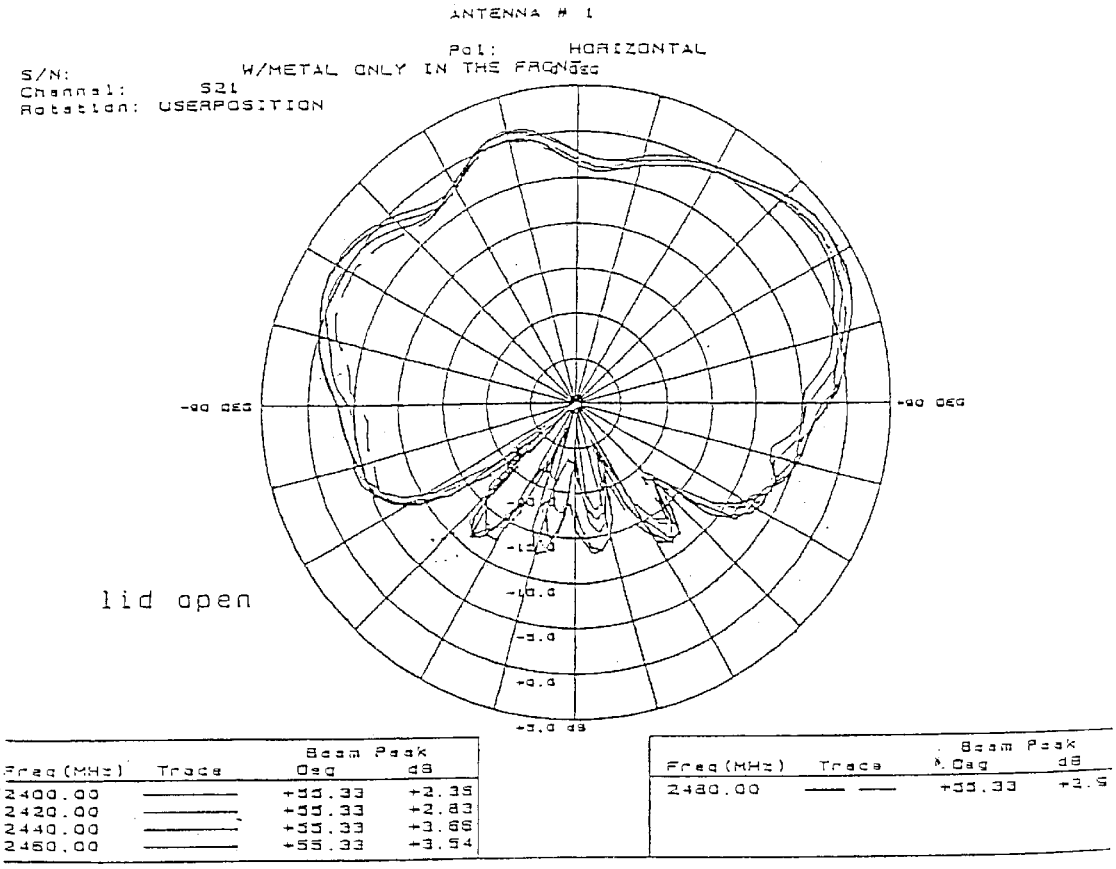
FIG. 13 is a graphical representation showing test data from an antenna designed in accordance with the present invention including the free-space azimuth pattern and a table setting forth the signal gain (in decibels) for a discrete five frequencies for the antenna #1 oriented in a user position (open) state and wherein the source antenna is horizontally polarized.

FIG. 12 and FIG. 13 are graphical representations showing test data from an antenna designed in accordance with the present invention including the free-space azimuth pattern and a table setting forth the signal gain (in decibels) for a discrete five frequencies for the antenna #2 (FIG. 12) and antenna #1 (FIG. 13) oriented in a user position (open) state and wherein the source antenna was horizontally polarized. Readily apparent to those of skill in the art is how well antenna #1 responds to horizontally polarized signals in this orientation compared to antenna #2. In a diversity situation where the incoming radio waves are horizontally polarized, antenna #1 would be the antenna selected for data transfer operations.

Figure 14:
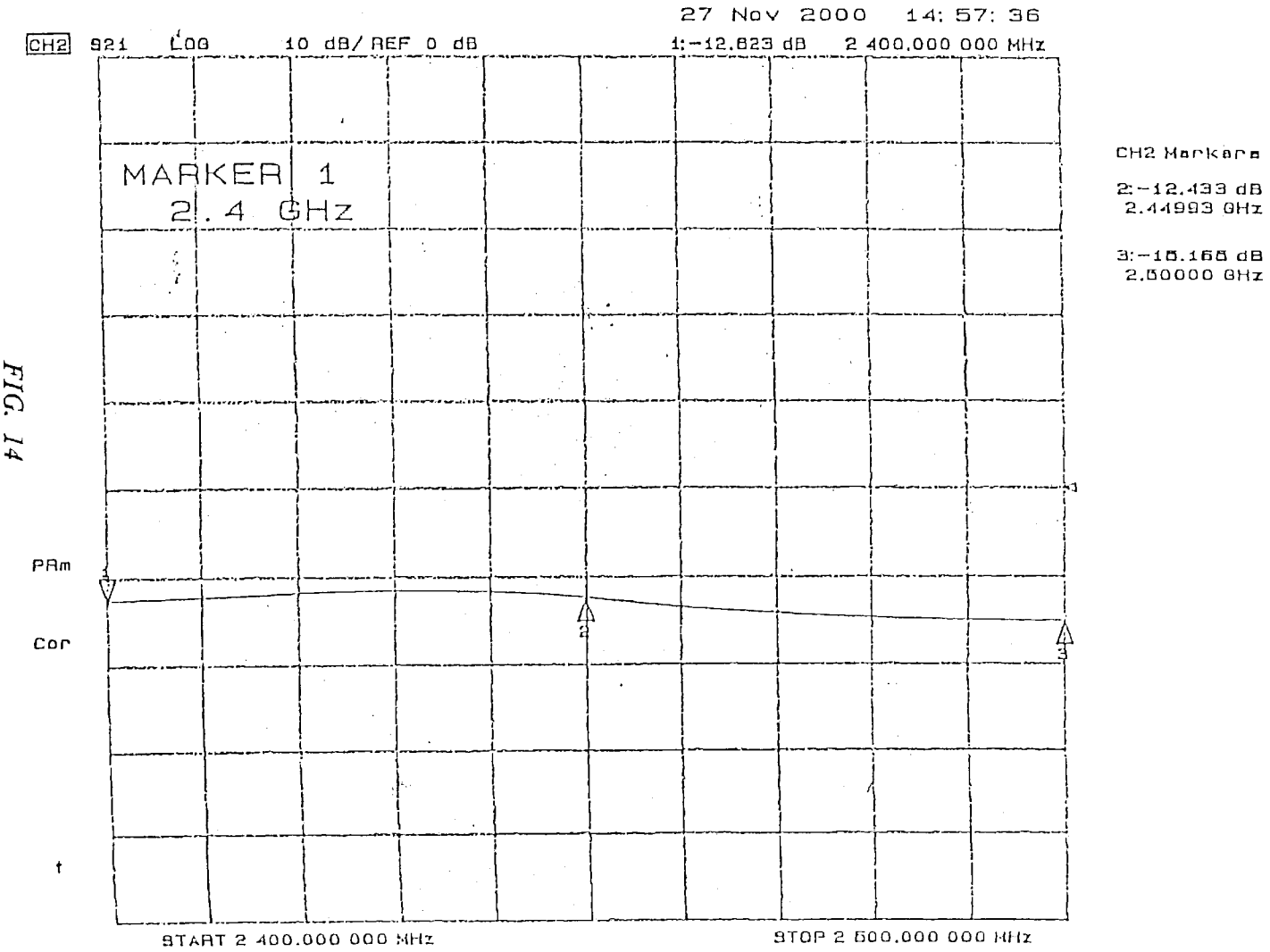
FIG. 14 is a graph representing the isolation response between antenna #1 and antenna #2, and in particular, illustrating the relatively minimal effects of mutual coupling with more than forty decibels of isolation between antenna #1 and antenna #2.

FIG. 14 is a graph representing the isolation response between antenna #1 and antenna #2, and in particular, illustrating the relatively minimal effects of mutual coupling with more than ten decibels of isolation between antenna #1 and antenna #2.

Figure 15:
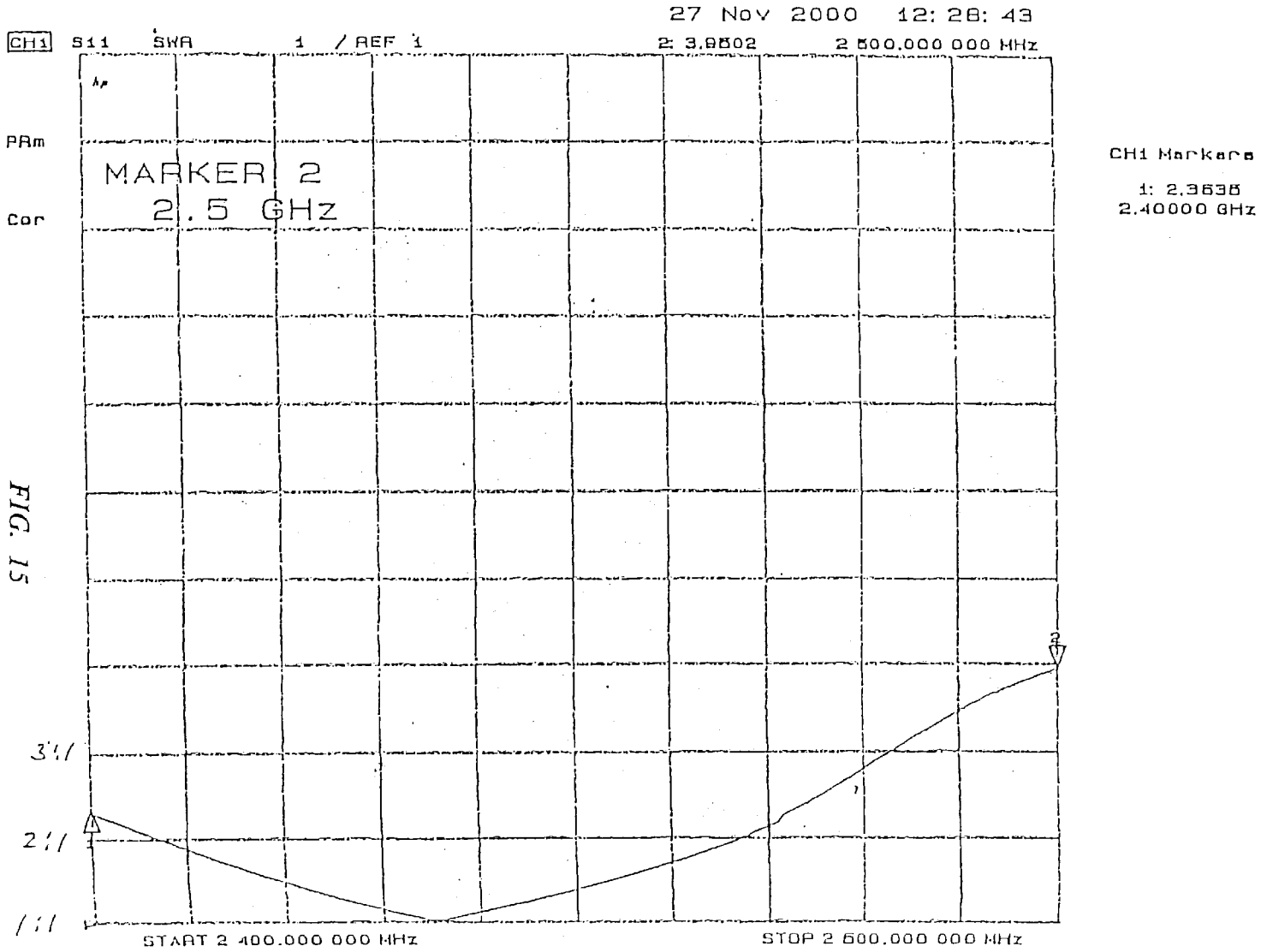
FIG. 15 is a graph representing the input voltage standing wave ratio (VSWR) of antenna #2 illustrating excellent matching in the center portion of the frequency band (i.e., midway between 2.4 GHz and 2.5 GHz).

FIG. 15 is a graph representing the input voltage standing wave ratio (VSWR) of antenna #2 illustrating excellent matching in the center portion of the frequency band (i.e., midway between 2.4 GHz and 2.5 GHz).

Figure 16:
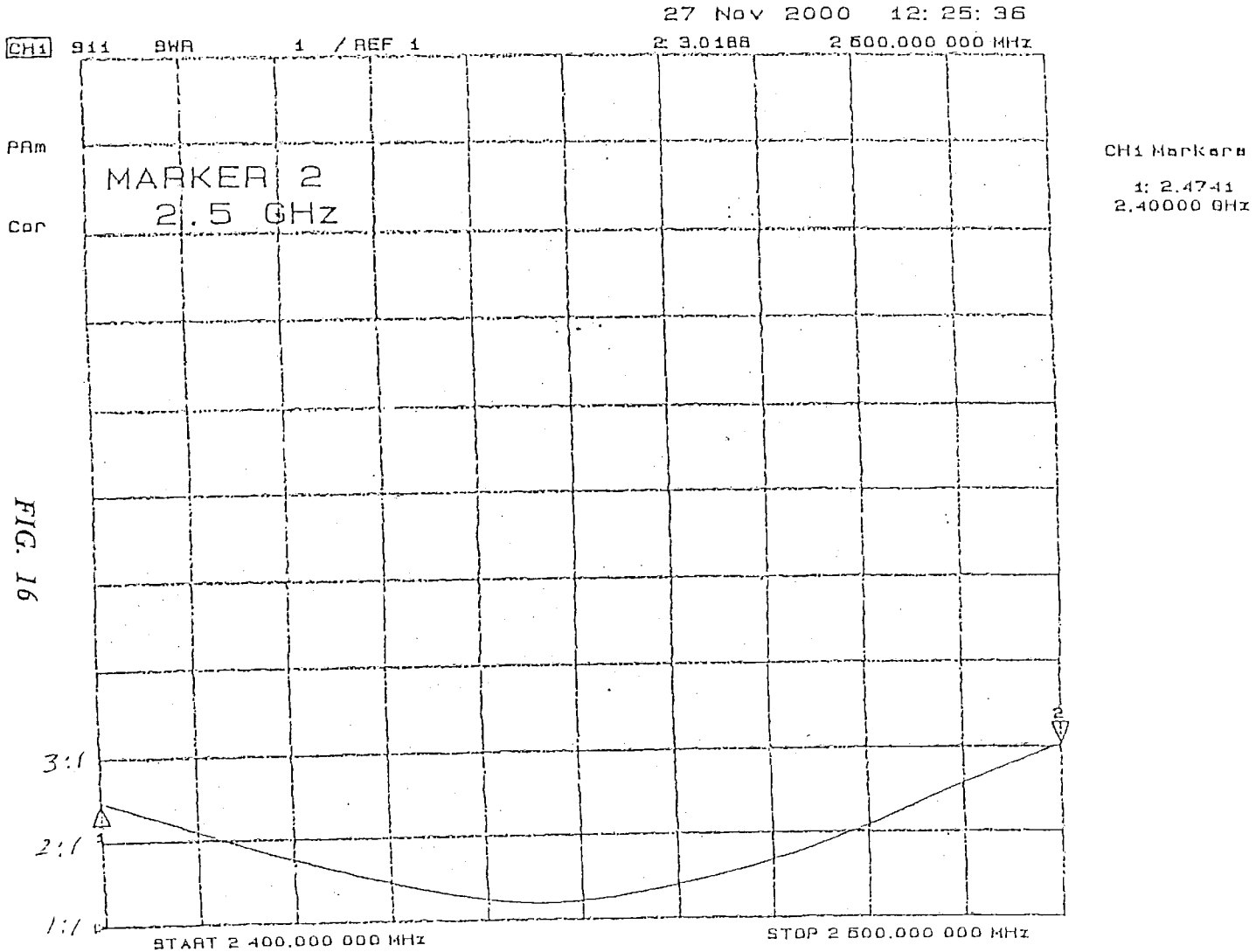
FIG. 16 is a graph representing the input voltage standing wave ratio (VSWR) of antenna #1 illustrating excellent matching in the center portion of the frequency band (i.e., midway between 2.4 GHz and 2.5 GHz).

FIG. 16 is a graph representing the input voltage standing wave ratio (VSWR) of antenna #1 illustrating excellent matching in the center portion of the frequency band (i.e., midway between 2.4 GHz and 2.5 GHz).

Other aspects and advantages of the invention as taught, enabled, and illustrated herein are readily ascertainable to those skilled in the art to which the present invention is directed, as well as insubstantial modifications or additions, all of the above of which falls clearly with the spirit and scope of the present invention as defined and specifically set forth in each individual claim appended hereto. The following drawings are intended to illustrate one ore more embodiments of the present invention and are not intended to limit the scope and breadth of the invention hereof, which invention shall be as broad and have reach as defined in the claims appended hereto and in reference to the whole of the disclosure hereof as understood by those of skill in the art of wireless technology generally, and the science and art of antenna and antenna system design, operation, and manufacture.

We claim:

1. A diversity antenna system for a wireless communication device having a transceiver component and a generally planar ground plane element, said diversity antenna system including at least a pair of antenna structures, each antenna structure comprising:

a first generally planar conductive element being in general parallel alignment with the ground plane element;

a first generally planar conductive leg portion being operatively coupled to both the first conductive element and to the ground plane element;

a second generally planar conductive leg portion being operatively coupled to both the first conductive element and to the ground plane element; and a feed point defined upon the first conductive element, said feed point for operatively coupling the antenna assembly to the transceiver component of the wireless communications device, wherein the first and second conductive leg portions are coupled to the first conductive element at different sides, wherein the feed point is defined on a side different from the sides associated with the first and second conductive leg portions, and wherein the feed point and the second conductive leg portion are defined upon opposite sides of the first conductive element.

2. The antenna structure for a diversity antenna system according to claim 1, wherein the first conductive element and the first and second conductive leg portions are formed from a unitary metal part.

3. The antenna structure for a diversity antenna system according to claim 1, wherein the first conductive element and the first and second conductive leg portions are formed by a metal plating over a substrate element.

4. The antenna structure for a diversity antenna system according to claim 1, wherein the first conductive element is generally rectangular in shape and having 4 sides.

5. The antenna structure for a diversity antenna system according to claim 1, wherein the first conductive element has a plurality of notch structures defined thereupon.

6. The antenna structure for a diversity antenna system according to claim 5, wherein the notch structures are generally rectangular in shape.

7. The antenna structure for a diversity antenna system according to claim 1, wherein a first notch structure is generally adjacent to the first conductive leg portion.

8. The antenna structure for a diversity antenna system according to claim 1, wherein the first and second conductive leg portions are coupled to the first conductive element at adjacent sides.

9. A diversity antenna system for a wireless communication device having a transceiver component and a generally planar ground plane element, said diversity antenna system including at least a pair of antenna structures, each antenna structure comprising:

a first generally planar conductive element being in general parallel alignment with the ground plane element;

a first generally planar conductive leg portion being operatively coupled to both the first conductive element and to the ground plane element;

a second generally planar conductive leg portion being operatively coupled to both the first conductive element and to the ground plane element; and a feed point defined upon the first conductive element, said feed point for operatively coupling the antenna assembly to the transceiver component of the wireless communications device, wherein the first and second conductive leg portions are substantially differently sized.

10. A diversity antenna system for a wireless communication device having a transceiver component and a generally planar ground plane element, said diversity antenna system including at least a pair of antenna structures, each antenna structure comprising:

a first generally planar conductive element being in general parallel alignment with the ground plane element;

a first generally planar conductive leg portion being operatively coupled to both the first conductive element and to the ground plane element;

a second generally planar conductive leg portion being operatively coupled to both the first conductive element and to the ground plane element; and a feed point defined upon the first conductive element, said feed point for operatively coupling the antenna assembly to the transceiver component of the wireless communications device, wherein a first notch structure is generally adjacent to the first conductive leg portion, and wherein a second notch structure and a third notch structure are each generally adjacent to the second conductive leg portion.

11. A diversity antenna system for a wireless communication device having a transceiver component and a generally planar ground plane element, said diversity antenna system including at least a pair of antenna structures, each antenna structure comprising:

a first generally planar conductive element being in general parallel alignment with the ground plane element;

a first generally planar conductive leg portion being operatively coupled to both the first conductive element and to the ground plane element;

a second generally planar conductive leg portion being operatively coupled to both the first conductive element and to the ground plane element; and a feed point defined upon the first conductive element, said feed point for operatively coupling the antenna assembly to the transceiver component of the wireless communications device, wherein the first conductive element has a plurality of notch structures defined thereupon, and wherein the feed point is defined within one of the plurality of notch structures.

12. The diversity antenna system according to claim 11, wherein the first and second conductive leg portions are coupled to the first conductive element at adjacent sides.

13. A diversity antenna assembly for a wireless communication device having a transceiver component and a generally planar ground plane element, said diversity antenna assembly comprising:

a first antenna element and a second antenna element, each antenna element being generally elongated and having a longitudinal direction, wherein the longitudinal directions of the antenna elements are generally orthogonally aligned, and wherein each of the antenna elements further comprise:

a first conductive element, said conductive element being generally planar and in general parallel alignment with the ground plane element;

a first conductive leg portion, said leg portion being generally planar and operatively coupled both to the first conductive element and to the ground plane element;

a second conductive leg portion, said leg portion being generally planar and operatively coupled both to the first conductive element and to the ground plane element; and a feed point defined upon the first conductive element, said feed point for operatively coupling the antenna assembly to the transceiver component of the wireless communications device, wherein the first and second conductive leg portions are coupled to the first conductive element at different sides, wherein the feed point is defined on a side different from the sides associated with the first and second conductive leg portions, and wherein the feed point and the second conductive leg portion are defined upon opposite sides of the first conductive element.

14. The diversity antenna assembly according to claim 13, wherein the first conductive element and the first and second conductive leg portions are formed from a unitary metal part.

15. The diversity antenna assembly according to claim 13, wherein the first conductive element is generally rectangular in shape and having 4 sides.

16. A diversity antenna assembly for a wireless communication device having a transceiver component and a generally planar ground plane element, said diversity antenna assembly comprising:

a first antenna element and a second antenna element, each antenna element being generally elongated and having a longitudinal direction, wherein the longitudinal directions of the antenna elements are generally orthogonally aligned, and wherein each of the antenna elements further comprise:

a first conductive element, said conductive element being generally planar and in general parallel alignment with the ground plane element;

a first conductive leg portion, said leg portion being generally planar and operatively coupled both to the first conductive element and to the ground plane element;

a second conductive leg portion, said leg portion being generally planar and operatively coupled both to the first conductive element and to the ground plane element; and a feed point defined upon the first conductive element, said feed point for operatively coupling the antenna assembly to the transceiver component of the wireless communications device, wherein the first and second conductive leg portions are substantially differently sized.

17. A diversity antenna assembly for a wireless communication device having a transceiver component and a generally planar ground plane element, said diversity antenna assembly comprising:

a first antenna element and a second antenna element, each antenna element being generally elongated and having a longitudinal direction, wherein the longitudinal directions of the antenna elements are generally orthogonally aligned, and wherein each of the antenna elements further comprise:

a first conductive element, said conductive element being generally planar and in general parallel alignment with the ground plane element;

a first conductive leg portion, said leg portion being generally planar and operatively coupled both to the first conductive element and to the ground plane element;

a second conductive leg portion, said leg portion being generally planar and operatively coupled both to the first conductive element and to the ground plane element; and a feed point defined upon the first conductive element, said feed point for operatively coupling the antenna assembly to the transceiver component of the wireless communications device, wherein the first conductive element has a plurality of notch structures defined thereupon, wherein a first notch structure is generally adjacent to the first conductive leg portion, and wherein a second notch structure and a third notch structure are each generally adjacent to the second conductive leg portion.

18. The diversity antenna assembly of claim 17, wherein the notch structures are generally rectangular in shape.

19. The diversity antenna assembly of claim 17, wherein the feed point is defined within one of the plurality of notch structures.

20. A low profile PIFA antenna for a wireless communications device having a ground plane element and a transceiver component, said antenna comprising:

a first generally planar conductive element being in general parallel alignment with the ground plane element;

a first generally planar conductive leg portion being operatively coupled to both the first conductive element and to the ground plane element;

a second generally planar conductive leg portion being operatively coupled to both the first conductive element and to the ground plane element; and a feed point for operatively coupling the antenna assembly to the transceiver component of the wireless communications device, wherein the first and second conductive leg portions are coupled to the first conductive element at different sides, wherein the feed point is defined on a side different from the sides associated with the first and second conductive leg portions, and wherein the feed point and the second conductive leg portion are defined upon opposite sides of the first conductive element.

21. The antenna of claim 20, further comprising:

a third generally planar conductive leg portion being operatively coupled to both the first conductive element and to the transceiver component of the wireless communications device, and wherein the feed point is defined upon said third generally planar conductive leg portion.

22. The antenna of claim 21, wherein the first conductive element and the conductive leg portions are formed from a unitary metal part.

23. The antenna of claim 21, wherein the conductive leg portions are coupled to the first conductive element at different sides.

24. The antenna of claim 20, wherein the feed point is defined upon the first conductive element.

25. The antenna of claim 20, wherein the first conductive element is generally rectangular in shape and having 4 sides.

26. The antenna of claim 20, wherein the first conductive element has a plurality of notch structures defined thereupon.

27. The antenna of claim 20, wherein a distance along a perpendicular line between the first conductive element and the ground plane element is approximately $1/40^{th}$ of an operational wavelength.

28. A diversity antenna system for a wireless communication device having a transceiver component and a generally planar ground plane element, said diversity antenna system including at least a pair of antenna structures, each antenna structure comprising:

a first generally planar conductive element being in general parallel alignment with the ground plane element;

a first generally planar conductive leg portion being operatively coupled at a first edge to both the first conductive element and to the ground plane element;

a second generally planar conductive leg portion being operatively coupled at a second edge to both the first conductive element and to the ground plane element, said second edge being adjacent to the first edge; and a feed point defined upon the first conductive element, said feed point for operatively coupling the antenna assembly to the transceiver component of the wireless communications device, wherein the feed point is defined on an edge different from the first and second edges.

29. A diversity antenna system of claim 28 wherein the leg portions are substantially narrower than associated edges at which the leg portions are operatively coupled to the first conductive element.

30. A diversity antenna system of claim 28 wherein the leg portions have substantially different widths relative to each other.

31. A diversity antenna system of claim 28 wherein the leg portions are substantially orthogonally aligned relative to each other.

32. A diversity antenna system for a wireless communication device having a transceiver component and a generally planar ground plane element, said diversity antenna system comprising:

a pair of antenna structures, each antenna structure including, a first generally planar conductive element being in general parallel alignment with the ground plane element, each antenna structure being elongated in a predetermined direction, a first generally planar conductive leg portion being operatively coupled at a first edge to both the first conductive element and to the ground plane element, and a feed point defined upon the first conductive element, said feed point for operatively coupling the antenna assembly to the transceiver component of the wireless communications device, wherein the feed point is defined on a different edge from the first edge, and wherein the pair of antenna structures are aligned so that the predetermined directions are substantially orthogonal.

33. A diversity antenna system of claim 32 wherein each of the antenna structures include a second generally planar conductive leg portion being operatively coupled at a second edge to both the first conductive element and to the ground plane element, said second edge being adjacent to the first edge.

34. A diversity antenna system of claim 32 wherein the first edges having feed points defined thereupon are substantially orthogonally aligned relative to each other.

35. A diversity antenna system of claim 32 wherein the planar conductive elements are substantially rectangular in form.

36. A method of operating a wireless communications device within a wireless network, said device having a pair of operational states and having a transceiver component and a generally planar ground plane element, said method comprising the steps of:

providing a pair of antenna structures, each antenna structure including, a first generally planar conductive element being in general parallel alignment with the ground plane element, each antenna structure being elongated in a predetermined direction, a first generally planar conductive leg portion being operatively coupled at a first edge to both the first conductive element and to the ground plane element, and a feed point defined upon the first conductive element, said feed point for operatively coupling the antenna assembly to the transceiver component of the wireless communications device, wherein the feed point is defined on an opposite edge from the first edge, and wherein the pair of antenna structures are aligned so that the predetermined directions are substantially orthogonal;

operating the device in a first operational state wherein one of the pair of antenna structures is maximally responsive to a vertically polarized signal; and operating the device in a second operational state wherein the other of the pair of antenna structures is maximally responsive to the vertically polarized signal.

37. The method of claim 36, wherein the pair of antenna structures are provided upon a display portion of a laptop computer, and wherein the pair of operational states are defined by an orientation of the display portion relative to the rest of the laptop computer.

* * * * *